US005746667A

United States Patent [19]

Fraser et al.

[11] Patent Number: 5,746,667

[45] Date of Patent: May 5, 1998

[54] SUSPENSION TYPE GOLF TEE

[76] Inventors: Paul M. Fraser, 3155 Robenson Street, Regina, Saskatchewan, Canada, S4S IV6; Stanley Dwayne Proctor, 488 S. Cedar St., Allegan, Mich. 49010

[21] Appl. No.: 823,088

[22] Filed: Mar. 24, 1997

[51] Int. Cl.[6] ..... A63B 69/36

[52] U.S. Cl. ..... 473/393; 473/397; 473/145

[58] Field of Search ..... 473/131, 387, 473/392, 393, 396, 397, 145, 146, 149, 257, 138, 139, 147

[56] References Cited

U.S. PATENT DOCUMENTS

| | | | |
|---|---|---|---|
| 1,847,570 | 3/1932 | Mclaughlin . | |
| 2,159,122 | 3/1939 | Armstrong . | |
| 2,219,732 | 10/1940 | Armstrong . | |
| 2,466,115 | 4/1949 | McInnes et al. . | |
| 3,292,929 | 12/1966 | Russell | 473/392 |
| 3,397,885 | 8/1968 | Nash . | |
| 3,425,700 | 2/1969 | Edwards | 473/147 |
| 3,827,696 | 8/1974 | Shafer . | |
| 3,851,886 | 12/1974 | Acosta | 473/139 |
| 5,366,225 | 11/1994 | Lazar . | |
| 5,577,964 | 11/1996 | Chen | 473/145 |

*Primary Examiner*—Steven B. Wong
*Attorney, Agent, or Firm*—Samuel Kurlandsky

[57] ABSTRACT

A golf tee comprising a vertical member adapted to be struck into the ground, a transverse member pivotally engaged with the end of the vertical member and adapted to be adjustably moved angularly with respect to the vertical member and to retain its angular position therewith after such movement, and a string engaged at one end with the transverse member and engaged at the other end with a suction cup for engaging and supporting a golf ball above the ground. The transverse member may be pivotally moved to suspend the golf ball at the desired distance above the ground. When the golf ball is then struck with the head of a golf club, it encounters less impedance to true straight flight than a golf ball struck from a conventional tee. Longer driving distances can be achieved than when driving from a conventional tee. Moreover, there is less danger that the golf club will dig up a large divot of top soil than when the golf ball is struck from a conventional tee.

13 Claims, 2 Drawing Sheets

SUSPENSION TYPE GOLF TEE

BACKGROUND ART

Golf tees utilized for driving golf balls have conventionally been formed of wood or plastic material and comprise a pointed end which is driven into the ground and a small cup at the top utilized to support a golf ball.

When such tees are utilized, they are often destroyed during the driving swing.

Those skilled in the art have recognized the need for a golf tee where the structure which supports the ball is not in itself driven into the ground, but, instead, where the ball is suspended by a stringer which in turn is supported by a structure adapted to be struck into the ground. In U.S. Pat. No. 2,219,732, Armstrong, such a tee is shown comprising a vertical member having a portion adapted to be struck into the ground, a transverse arm affixed to the end of the vertical member, a stringer supported by the end of the transverse arm, the stringer terminating in a loop 13 adapted to engage and support a golf ball. The height of the golf ball above the ground is adjustably determined by having a portion 7 of the vertical member telescoped into a tubular member 5 and affixed by a screw 8. A similar structure is shown in FIG. 4 of U.S. Pat. No. 2,159,122, which additionally discloses a golf ball dispenser utilized with the golf ball suspension means.

U.S. Pat. No. 3,397,885 shows a similar device for suspending a baseball utilized in baseball practice. Here however, the baseball is not released from the harness but is retained thereby and merely swings over the transverse supporting member.

U.S. Pat. No. 2,466,115 discloses a golf tee comprising a peg 12 having a pointed end portion 20 for being struck into the ground, and having a transverse wire having an end pivoted in an opening in the peg 12. A loop 16 is provided at the other end of the arm 14 for supporting a golf ball.

Similar devices have been disclosed for golf ball practicing. In U.S. Pat. No. 1,847,570 a vertical member is affixed to a plate mounted on a floor having a transverse arm affixed to the vertical member and slidably adjustable thereto. A wire is connected at the end of the transverse member having a stringer affixed thereto, the end of the stringer being permanently affixed to a golf ball. U.S. Pat. No. 3,827,696 and U.S. Pat. No. 5,366,225 also show golf swing training apparatuses having golf balls suspended by a stringer, wherein the stringer is permanently affixed to the golf ball.

BACKGROUND OF THE INVENTION

TECHNICAL FIELD

The present invention relates to the field of sports, and more particularly refers to a golf tee adapted for maintaining a golf ball in a suspended state at a desired distance above the ground suitable for being struck with a golf club.

SUMMARY OF THE INVENTION AND ADVANTAGES

According to the present invention, a suspension type golf tee is provided having a vertical member with a lower end adapted to be struck into the ground, and a transverse member pivotally connected to the upper end of the vertical member and adapted to be pivoted angularly with respect to the vertical member, and, after adjustment, to remain in the desired pivotal position. A stringer has one end affixed to one end of the transverse member, and a golf ball engaging member affixed to the other end of the stringer. In operation, the vertical member is struck into the ground. The golf ball is engaged by the golf ball engaging member. The transverse member is then pivoted angularly with respect to the vertical member until the golf ball is suspended at the desired height above ground. The golf ball may then be struck with a golf club and it will follow a true trajectory without being impeded by the conventional tee and without digging up the turf during the golf swing.

DETAILED DESCRIPTION OF THE PREFERRED EMBODIMENTS

Figure 1:
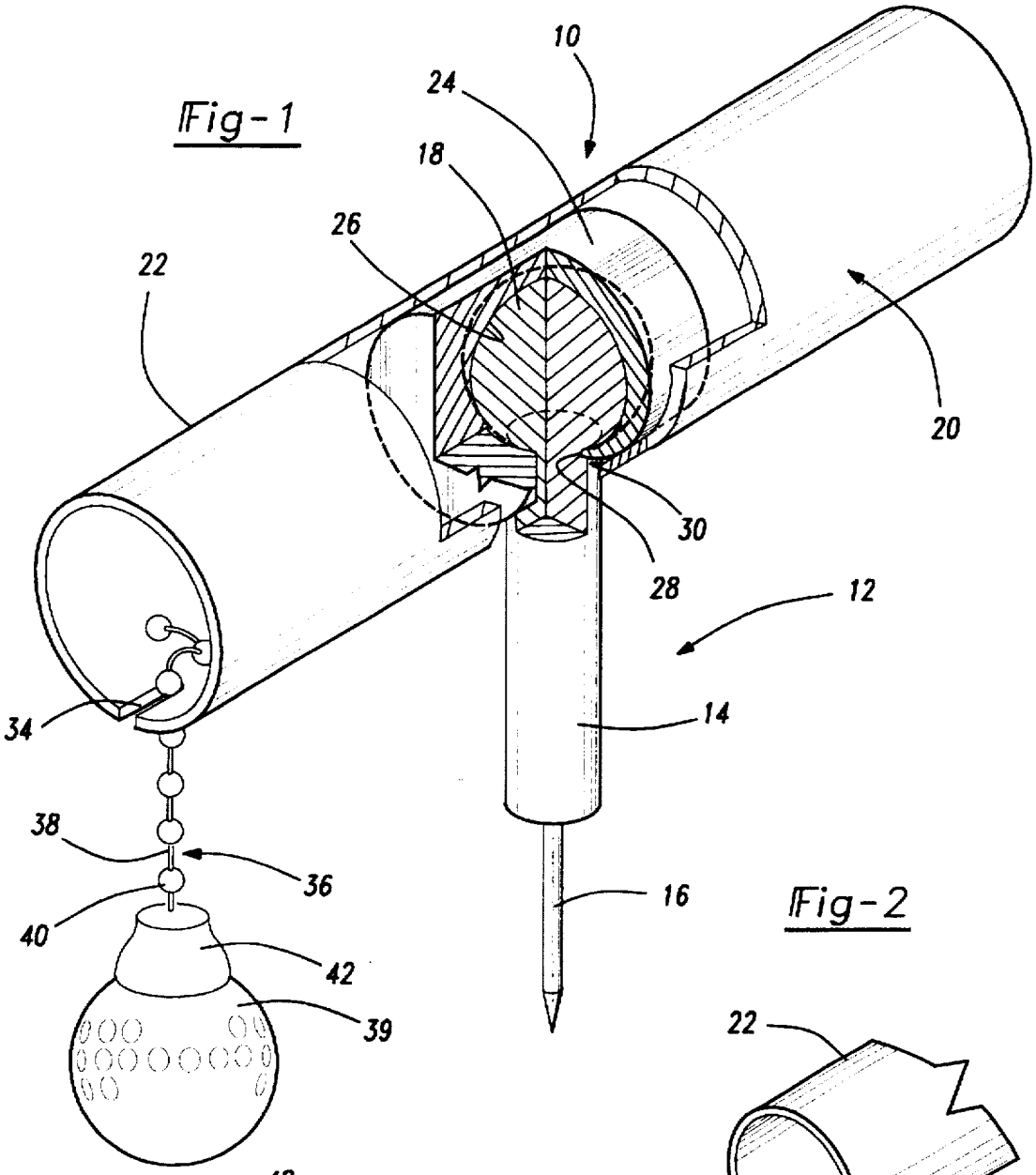
FIG. 1 is a perspective view of a golf tee according to the present invention, with a portion of the tube broken away to show the ball joint assembly.
Figure 2:
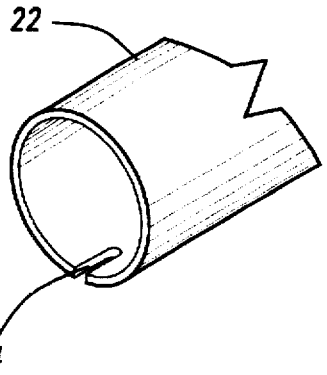
FIG. 2 is a fragmentary perspective view of the end of the tube comprising the transverse member.
Figure 3:
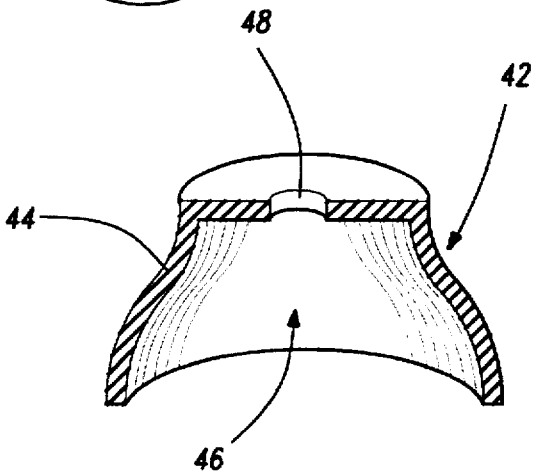
FIG. 3 is an axial sectional view of the suction cup shown in FIG. 1.

Referring to FIGS. 1–3, a suspension type golf tee (10) is shown comprising a vertical member (12) formed of a solid cylindrical body (14), a metal spike (16) having an end embedded in the end of the vertical member (12), and 20 a ball (18) integrally provided at the other end of the vertical member (12).

A transverse member (20) has a mid-portion pivotally connected to an end of the vertical member (12) and is formed of a tubular body (22) having a solid cylindrical insert (24) mounted therein. The cylindrical insert (24) is provided with a spherical cavity (26) adapted to receive and engage the ball (18) of the vertical member. The transverse member (20) is arranged to pivot angularly with respect to the vertical member (12). A tight fit is provided between the ball (18) and the spherical cavity (26) to provide sufficient friction so that the angular relationship between the vertical member and the transverse member remains fixed once adjustment is made. A constricted lip (28) is provided at the opening of the spherical cavity (26) to retain the ball (18) in a snap fit engagement. A portion of the tubular body (22) is cut away to provide an opening (30) in the side of thereof to permit the ball (18) to enter and engage the spherical cavity (26).

As shown in FIGS. 1 and 2, a slot (34) is provided at one end of the tubular body (22) to permit a stringer (36) to be engaged and retained in the slot (34).

As shown in FIG. 1, the stringer (36) comprises a string (38) formed of a plastic or rubber material having balls (40) of the same material integrally molded onto the string (38).

Referring to FIGS. 1 and 3, a suction cup (42) formed of a flexible material such as rubber is affixed to one end of the stringer (36) and has a flexible or elastic side wall (44) and a suction cavity (46), and engages a golf ball (39). An aperture (48) is provided for receiving and engaging the end of the stringer (36).

The vertical member (12) and the transverse member (20) may be formed of any suitable material such as various plastic materials, among which are polystyrene, polyethylene, phenol formaldehyde, various acrylics, or hard rubbers. The preferred material is Tenite II®, a trademark plastic material comprising cellulose acetate butyrate, marketed by National Lead Company. The cylindrical insert (24) may also be formed of a suitable plastic material. However, the preferred material is hard rubber in order to provide sufficient friction between the ball (18) and the spherical cavity surface (26), so that once the angular position of the transverse member (20) is adjusted in place, it will so remain. The spike (16) may be formed of any suitable strong material such as a metal, including iron and aluminum. A preferred material is stainless steel. The stringer (36) may be molded of rubber. It is preferred that the rubber be somewhat stiff so that the stringer is not readily swayed by the wind. The suction cup (42) is formed of any suitable elastomeric material such as rubber or various synthetic rubbers or elastomeric plastics.

In placing the suspension type golf tee (10) of the present invention shown in FIGS. 1–3 in operation, the transverse member (20) is grasped at the area where the end of the vertical member (12) is connected thereto. Force is placed on the structure and the spike (16) is driven into the ground. An end of the stringer (36) is inserted in the slot (34) and adjusted until the golf ball engaged by the suction cup (42) is suspended roughly at the desired height above ground. The transverse member (20) is then pivoted until the golf ball is exactly at the desired height above ground for driving the ball. There is sufficient friction between the ball (18) and the spherical cavity (26) to retain the relationship between the transverse member (20) and the vertical member (12) in the adjusted relationship. The golf ball may then be hit with a golf club.

Although the transverse member (20) has been shown to be formed of a tubular body (22) and having a solid cylindrical insert (24) mounted therein, alternatively the transverse member (20) may be formed of a solid body. The cavity (26) may then be molded or machined into the solid body (22) of the transverse member (20). Any suitable means such as a notch may then be provided in the end of the transverse member (20) to engage the end of the stringer (36).

Although in FIG. 1 the end of the vertical member (12) has been shown in the form of a ball (18), alternatively the structure may be in the form of a disk. The disk may then be engaged in the spherical cavity (26) and it will function in much the same manner as a ball. In a further alternative embodiment, instead of providing a spherical cavity (26), the cavity may be instead provided in the form of a slot to receive the disk of the vertical member.

Figure 4:
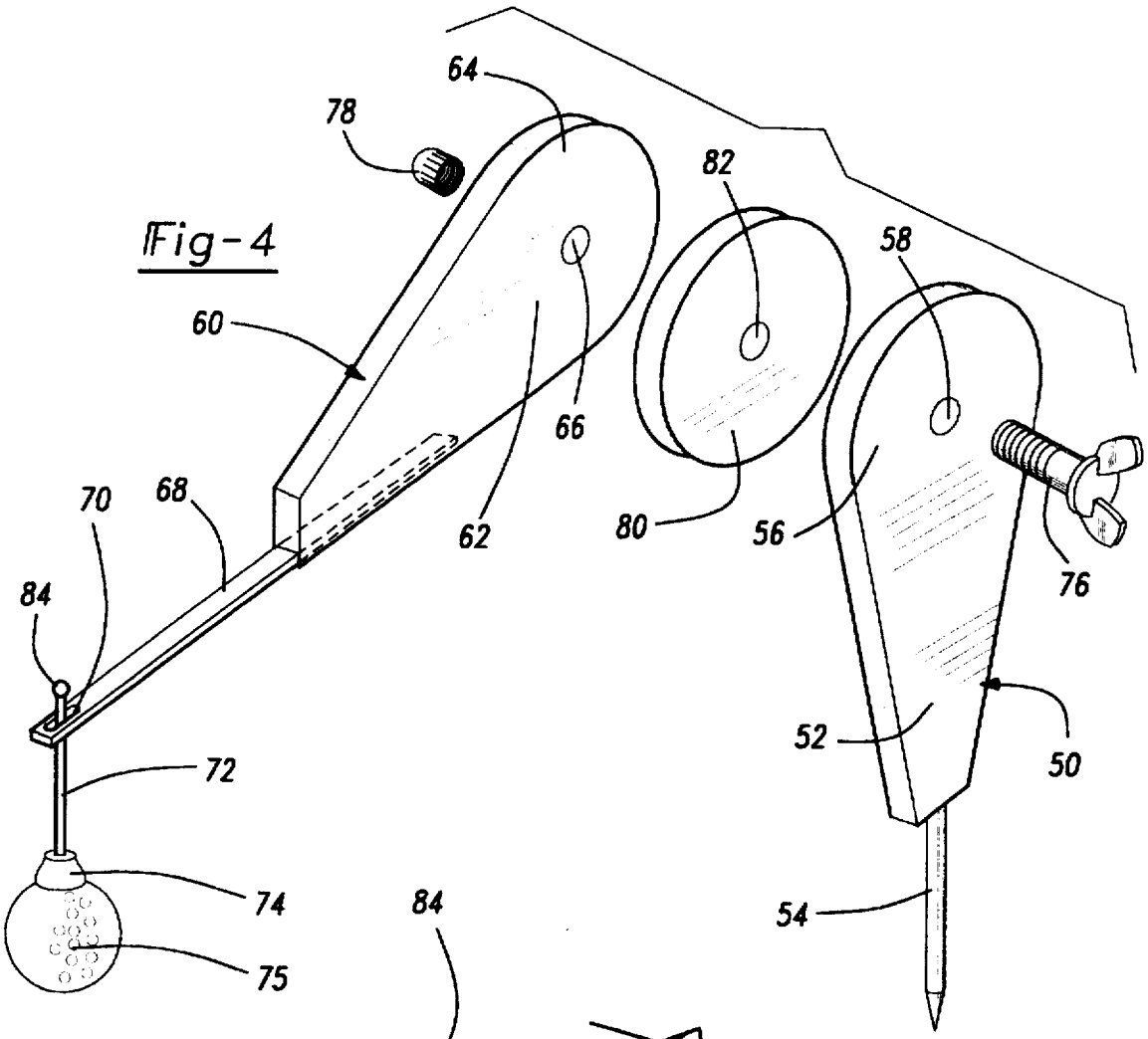
FIG. 4 is an exploded perspective view of another embodiment of the invention.
Figure 5:
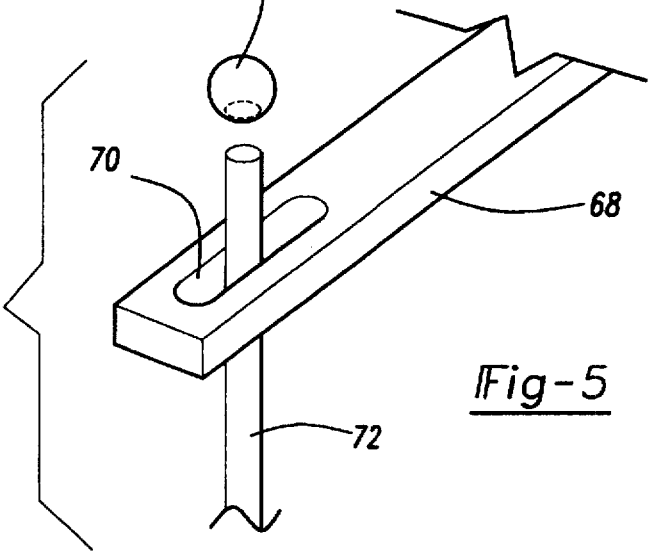
FIG. 5 is a fragmentary perspective view of the end of the lateral member (68) and stringer (72).

Referring to FIGS. 4 and 5, another embodiment of the invention is shown in exploded perspective views comprising a vertical member (50) having a body (52) formed of a suitable material such as plastic, including Tenite II®, or other suitable materials, and having a spike (54) with an end embedded in the body (52). The spike (54) may be formed of any strong materials such as iron or aluminum. Stainless steel is the preferred material. The vertical member (50) is provided with a disk-form pivot head (56) having a central aperture (58).

A transverse member (60) is formed of a body (62), a disk-form head (64) having a central aperture (66), and a lateral member (68). A retaining slot (70) is provided at the end of the lateral member (68) and is arranged to receive and retain in adjustable position a stringer (72). At the end of the stringer (72) is a suction cup (74) adapted to engage and retain a golf ball (75). A composite friction disk (80) having a central aperture (82) may be placed between the disk (56) and the disk (64). A wing screw (76) and threaded steel insert (78) are utilized to retain the disk-form pivot head (56), the disk-form pivot head (64), and the composite friction disk (80) in engagement, and may be adjusted to provide the desired amount of friction among the three disks.

The transverse vertical member (50) and the transverse member (60) may be formed of any suitable material such as the various plastic materials referred to above. A preferred material is Tenite II®. The composite friction disk (80) may be formed of a suitable plastic or of a composite material of rubber and a suitable friction providing material.

The embodiment shown in FIGS. 4 and 5 may be placed in operation in a manner similar to that described with regard to the embodiment of FIGS. 1–3. The spike (54) of the vertical member (50) is first driven into the ground. A golf ball is then squeezed against the suction cup (74) until it is retained. The relationship of the stringer (72) and the retaining slot (70) are then adjusted roughly placing the ball at the desired height above the ground. The transverse member is then pivoted sufficiently until the golf ball is at exactly the height above ground desired. The ball may then be struck in the normal manner.

The present invention has many advantages over golf tees conventionally utilized and even over those disclosed in the art which are suspension type golf tees. A large number of people find the game of golf somewhat frustrating, and a good deal of that frustration results from not being able to hit the golf ball properly into the air. Additionally, a good deal of frustration results from removing large chunks of turf instead of hitting the ball properly. As a result, the owners of golf courses must constantly change tee-off areas to allow the turf to grow back. Further, each year a large number of trees are destroyed in order to provide sufficient wood for manufacturing the millions of tees that are broken. These problems are avoided by the golf tee of the present invention by avoiding the need to support the golf ball by a wood tee which is driven into the ground. Additionally, because the golf ball is retained at its top by a suction cup, at least the lower two-thirds of the golf ball is exposed to the head of the golf club. As a result there is the elimination of the problem of broken wood tees. Additionally the turf on the golf course is preserved. The present golf tee is strong but of light weight which is simple and inexpensive to produce, and easy to use, and it will not rust or weather. Further, it will not damage the golf ball or the head of the golf club.

The present suspension type golf tee has advantages over similar suspension types disclosed in the art.

It provides a strong tee which is light and easily carried, and which can be readily set up. Further, the use of a suction cup to retain and suspend the golf ball above the ground exposes the lower two-thirds of the ball to the golf club and there is no danger that the club will hit a portion of the tee and thereby cause damage. Moreover, the height of the golf ball above ground is very easily and precisely adjusted by means of the pivot or swivel type coupling between the vertical member and the transverse member. Other advantages over tees disclosed in the art are that the exposure of the lower two-thirds of the golf ball to the face of the club allows for excellent lift of the ball and prevents topping the ball which is often the case with a normal tee. The present invention having a suction cup permits the ball to be quickly attached to the cup and the height of the ball above ground may be precisely adjusted in a matter of seconds. Further, there is no need to modify the golf ball in order to attach it to the suspending device. Because of the use of a suction cup at the top of the ball, there is nothing to cushion or deaden the impact of the club on the ball. In the case of the string holders disclosed in the prior art patents. a good deal of interference results Further, with regard to the tee of the present invention, there is nothing to impede the direction of the ball, such as the hoop or saddle disclosed in the prior art. There are no materials on the present device exposed to the face of the club which would cause the club to be damaged. The present golf tee is made of high impact plastic and stainless steel, and will not rust or suffer weather damage.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

We claim:

1. A suspension type golf tee comprising:

a vertical member having a pointed lower end, a transverse member, a pivotal joint comprising a ball at one end of said vertical member and a spherical socket provided in said transverse member, said pivotal joint connecting the upper end of said vertical member to said transverse member, permitting angular movement between said transverse member and said vertical member, a stringer connected at one end to one end of said transverse member, and having a golf ball retaining means connected to the other end of said stringer, whereby the pointed end of said vertical member may be struck into the ground, a golf ball engaged by said golf ball retaining means, and said transverse member may be pivoted angularly with respect to said vertical member, until said golf ball is suspended at the desired height above ground for hitting the ball with a golf club.

2. A suspension type golf tee according to claim 1, wherein said golf ball retaining means is a suction cup formed of rubber.

3. A suspension type golf tee according to claim 1, wherein said stringer is formed of rubber.

4. A suspension type golf tee according to claim 1, wherein the pointed end of said vertical member is comprised of a stainless steel spike affixed thereto.

5. A suspension type golf tee comprising:

a vertical member having a pointed lower end and a ball mounted on the upper end thereof, a tubular transverse member having a solid cylindrical insert mounted therein, a pivotal joint connecting the upper end of said vertical member to said transverse member comprising a spherical socket provided in said solid cylindrical insert, said spherical socket and said tubular transverse member having apertures in the sidewalls thereof, the ball of the upper end of said vertical member being disposed in said spherical socket, thereby permitting angular movement between said transverse member and said vertical member, a stringer connected at one end to one end of said transverse member, and having a golf ball retaining means in the form of a rubber suction cup connected to the other end of said stringer, whereby the pointed end of said vertical member may be struck into the ground, a golf ball engaged by said golf ball retaining means, and said transverse member may be pivoted angularly with respect to said vertical member until said golf ball is suspended at the desired height above ground for hitting the ball with a golf club.

6. A suspension type golf tee according to claim 5, wherein said vertical member and said transverse member are formed of a plastic material.

7. A suspension type golf tee according to claim 5, wherein said plastic material is cellulose acetate butyrate.

8. A suspension type golf tee according to claim 5, said cylindrical insert is formed of a composition including rubber.

9. A suspension type golf tee according to claim 5, wherein the pointed lower end of said vertical member is formed of stainless steel.

10. A suspension type golf tee according to claim 5, wherein said stringer is formed of rubber.

11. A suspension type golf tee according to claim 10, wherein a plurality of balls are integrally molded on said stringer in spaced apart relationship.

12. A suspension type golf tee according to claim 5, wherein a slot is provided at one end of said horizontal member adapted to engage one end of said stringer.

13. A suspension type golf tee according to claim 3, wherein a plurality of balls are integrally molded on said stringer in spaced apart relationship.

* * * * *